US007380679B2

(12) United States Patent
Conrad et al.

(10) Patent No.: US 7,380,679 B2
(45) Date of Patent: Jun. 3, 2008

(54) CONNECTABLE CONTAINERS

(75) Inventors: Jeffrey Conrad, Akron, OH (US); William Edwin Kerner, Berea, OH (US)

(73) Assignee: American Greetings Corp., Cleveland, OH (US)

( * ) Notice: Subject to any disclaimer, the term of this patent is extended or adjusted under 35 U.S.C. 154(b) by 155 days.

(21) Appl. No.: 10/870,474

(22) Filed: Jun. 18, 2004

(65) Prior Publication Data

US 2005/0279744 A1 Dec. 22, 2005

(51) Int. Cl.
*A47G 19/00* (2006.01)
*B65D 21/02* (2006.01)
*B65D 25/00* (2006.01)

(52) U.S. Cl. ..... 220/23.4; 220/23.91; 220/737

(58) Field of Classification Search ..... 220/23.2, 220/23.6, 23.4, 23.91, 737; 206/504, 485
See application file for complete search history.

(56) References Cited

U.S. PATENT DOCUMENTS 2,328,338 A * 8/1943 Hauptman ..... 215/12.1
3,194,426 A * 7/1965 Brown, Jr. ..... 220/23.4
3,356,245 A * 12/1967 Little ..... 220/4.24
4,252,258 A 2/1981 Plummer, III
4,656,840 A * 4/1987 Loofbourrow et al. ..... 62/530
4,735,342 A 4/1988 Goldstein
4,739,902 A 4/1988 Joslyn et al.
4,770,297 A * 9/1988 Chang ..... 206/379
5,024,067 A * 6/1991 Maier, II ..... 62/457.4
5,050,755 A * 9/1991 Strawder ..... 220/23.4
5,299,700 A * 4/1994 Beniacar ..... 215/12.1
5,381,916 A * 1/1995 Strawder ..... 220/23.4
5,467,894 A 11/1995 Altonen et al.
5,709,304 A * 1/1998 Credle, Jr. ..... 206/501
5,950,959 A 9/1999 Milliorn
6,276,550 B1 * 8/2001 Cherrington ..... 220/23.4
D458,124 S 6/2002 Kvame

* cited by examiner

*Primary Examiner*—Anthony D. Stashick
*Assistant Examiner*—Shawn M. Braden
(74) *Attorney, Agent, or Firm*—Roetzel & Andress

(57) ABSTRACT

Connectable containers provide a vessel with a cavity formed by walls with interconnecting structures whereby multiple containers can be connected in series or chains in different arrangements. A cap to each container with an operable cover enables holding and dispensing of items or product of size appropriate to the container cavity.

9 Claims, 3 Drawing Sheets

CONNECTABLE CONTAINERS

FIELD OF THE INVENTION

The present invention pertains generally to containers, and more particularly to containers which are connectable, linkable or otherwise configurable.

BACKGROUND OF THE INVENTION

Different types of containers have been made for packaging and dispensing of items, including products of very small size such as pills or paper clips. Such containers or dispensers are commonly made of plastic and have a base and an easily operable cap or other opening for releasing the product. The relative small size of such containers allows them to be packaged in bulk, such as within a larger container such as a box, and/or shrink-wrapped together. It is desirable for small product containers which contain the same or complimentary products to be held together or in close proximity for organization, dispensing and storage.

SUMMARY OF THE INVENTION

In accordance with one aspect of the invention, a connectable container or product container is provided which has four walls and a bottom defining an internal volume or cavity for holding a quantity of a product, and a removable cover or cap for closing off and providing access to the cavity for dispensing of product. One or more walls of the container are configured to engagement with an opposing wall of an identical or complimentary container, so that multiple containers can be connected or joined in one or more arrangements.

In accordance with other aspects of the invention, a connectable container has a first wall with at least one male projection, a second wall opposed to the first wall, the second wall having a female indentation configured to receive the male projection of the first wall, a third wall extending from the first wall to the second wall, and a fourth wall opposed to the third wall and extending from the first wall to the second wall, a bottom joined to co-planar edges of the first, second, third and fourth walls, the container having an opening opposed to the bottom, and a cover which fits over the opening, the cover having a lid operable to be opened or closed relative to the opening.

In accordance with another aspect of the invention, there is provided a series of connected containers, each container having a first wall having a projection; a second wall generally opposed to the first wall, the second wall having an indentation which corresponds to the projection of the first wall so that the projection of the first wall fits within the indentation in the second wall whereby a first wall of one container is connectable to a second wall of another container; a third wall which extends between the first wall and second wall, the third wall having a projection; a fourth wall generally opposed to the third wall and extending between the first wall and second wall, the fourth wall having an indentation which corresponds to the projection of the third wall so that the projection of the third wall fits within the indentation in the fourth wall whereby a third wall of one container is connectable to a fourth wall of another container; a bottom from which each of the walls extends, the bottom and walls defining a cavity to the container; and a cap connected to the walls generally opposed to the bottom, the cap having a cover; the series of connected containers comprising two or more containers connected by interengagement of corresponding projections and indentations of the walls.

DETAILED DESCRIPTION OF PREFERRED AND ALTERNATE EMBODIMENTS

Figure 1:
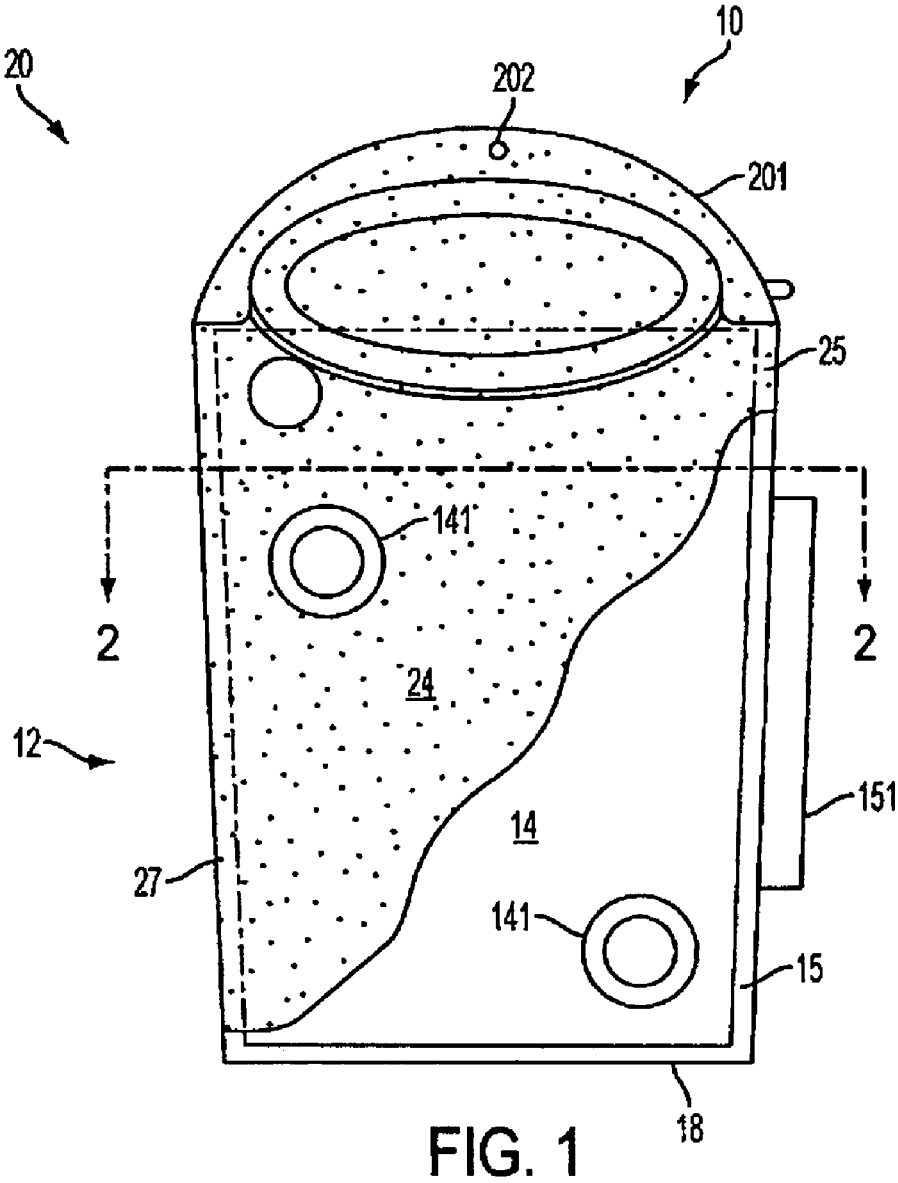
FIG. 1 is an elevation of a connectable container of the present invention.
Figure 2:
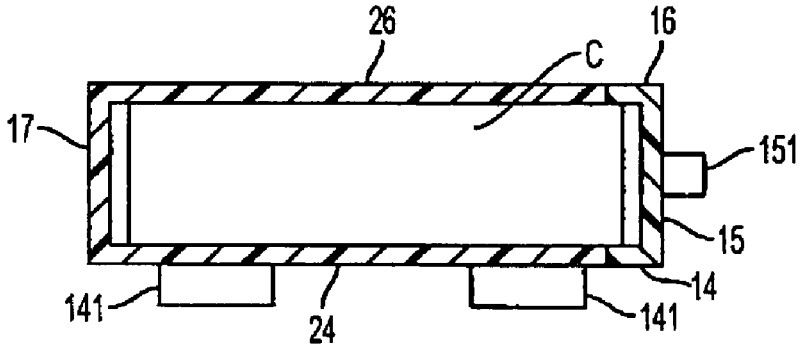
FIG. 2 is a cross-sectional view of the connectable container of FIG. 1, taken in the direction of the arrows 2-2 in FIG. 1.

As shown in the Figures, a container, indicated generally at 10, has a body 12 shown in a generally rectangular or cubic configuration, with a front wall 14 (also referred to as a "first wall"), rear wall 16 (also referred to as a "second wall" and which is opposed to the front wall 14), side wall 15 (also referred to as a "third wall"), side wall 17 (also referred to as the "fourth wall", and which is opposed to side wall 15), and bottom 18, joined together to form the body 12 which defines a cavity C constituting the internal volume of the container 10. The top edges of the walls 14, 16, 15 and 17 opposite bottom 18 can be left open or covered by a cap, indicated generally at 20. The cap 20 can be any type of structure which fits over or on top of walls 14, 16, 15 and 17 to cover the opening or access to the cavity C. In the embodiment shown, the cap 20 has an extended structure which includes its own side walls 24, 26, 25 and 27 which extend from a top section 21 to fit over or be otherwise engaged with the corresponding side walls 14, 16, 15 and 17 of the container body 12. Incorporated into the top section 21 of cap 20 is a cover 201, which in the form shown is a type of lid, attached by a hinge 202 to be operable between closed and opened positions for contained and releasing product from the container.

Figure 3:
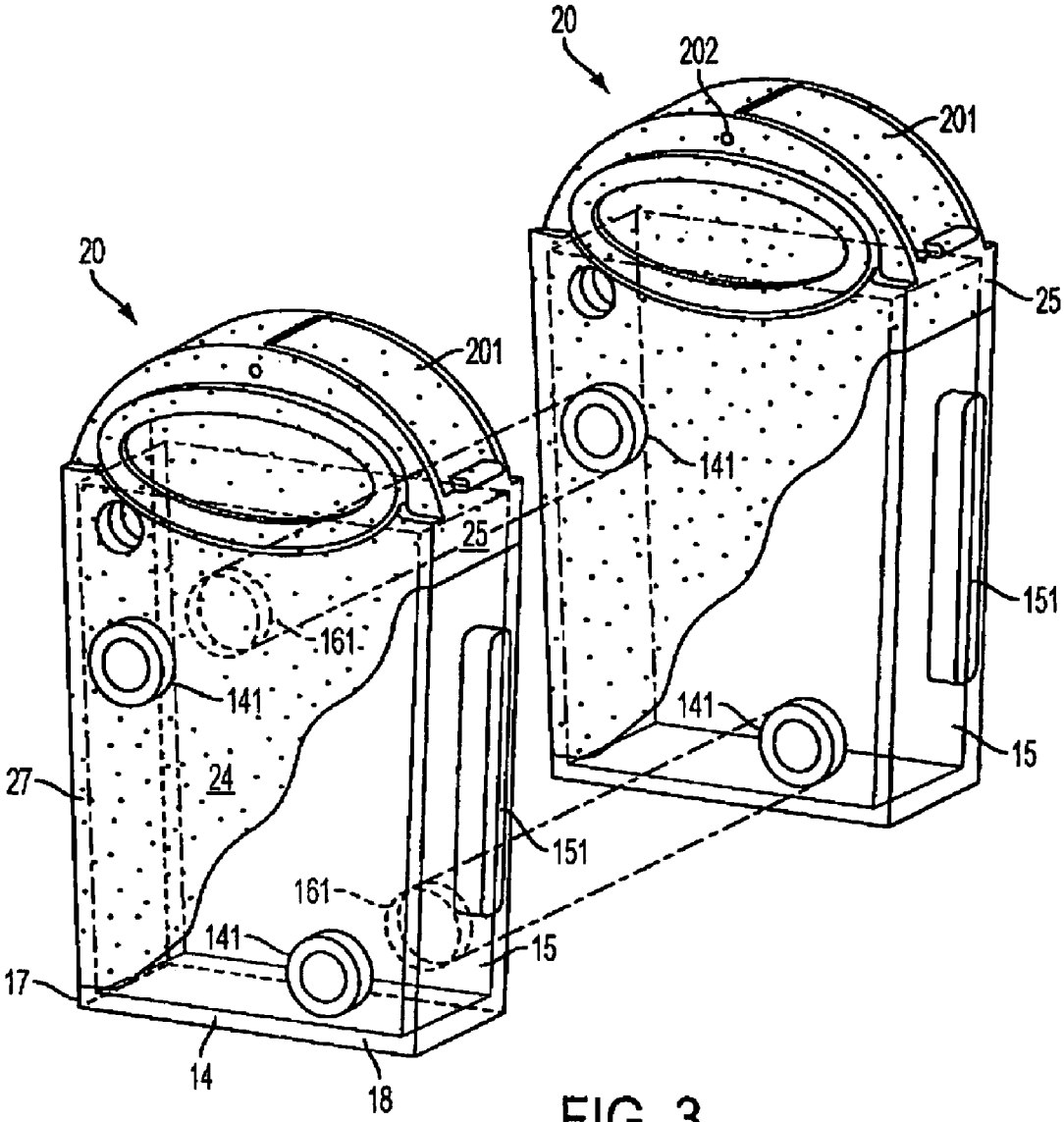
FIG. 3 is a perspective view of two connectable containers of the present invention.

To enable connection of one or more of the containers 10, one of the side walls, such as wall 14 (also referred to as a "first wall") may be provided with one or more protrusions or projections 141, which as shown may be in the form of a cylindrical structure or annular projection which extends out from the plane of wall 14, and is configured for engagement with a correspondingly sized annular indentation 161 in the opposing wall 16 of another container 10, as shown in FIG. 3. Although shown in a generally cylindrical or annular configuration, any other forms or shapes of projection 141 and correspondingly shaped indentation 161 which accomplishes inter-engagement of containers between the side walls 14 and 16 are within the scope of the invention. The nomenclature of "first", "second", "third" and "fourth" walls is for convenient reference only and does not restrict the invention to any particular relative arrangement of the various walls and the structural features thereof.

Figure 4:
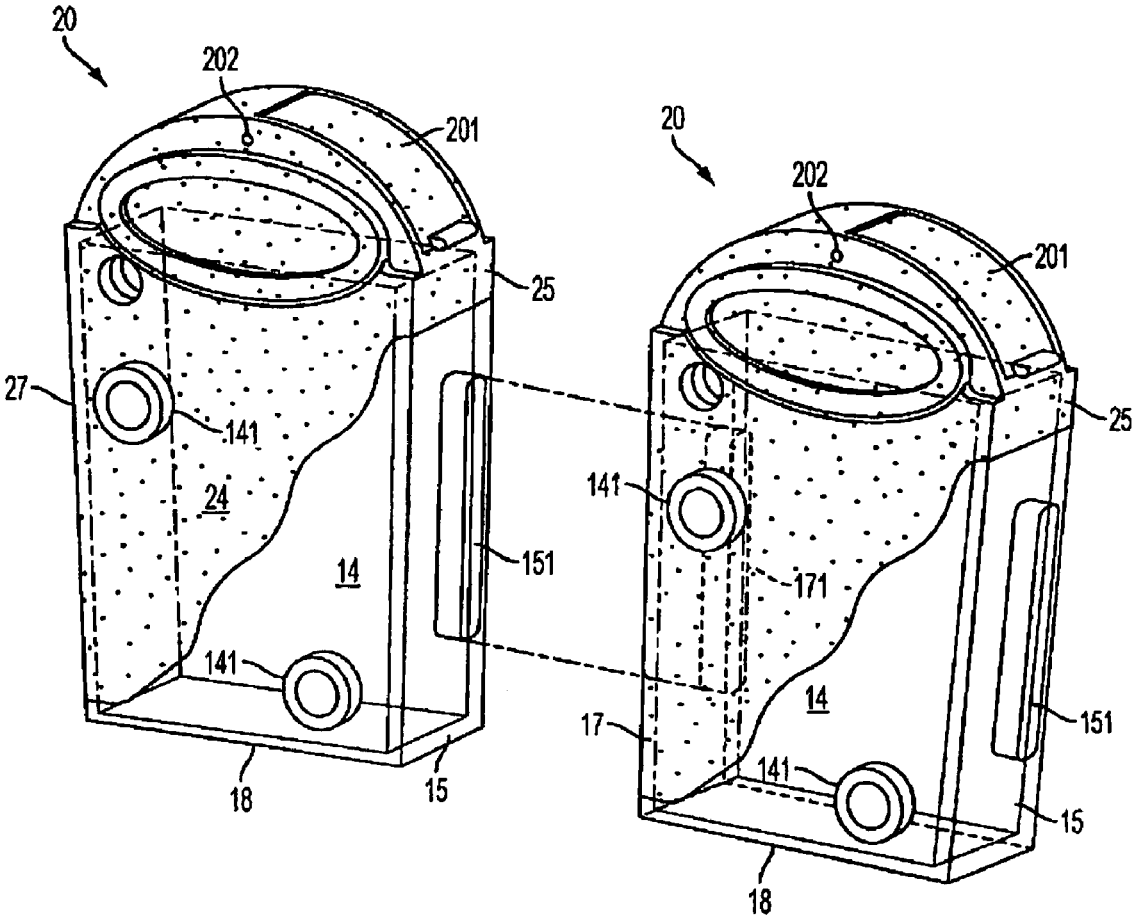
FIG. 4 is a perspective view of two connectable containers of the present invention.

Similar inter-engaging structures are provided on walls 15 and 17, such as the projection 151 of wall 15, which as shown may be in the form of a raised rib, and the corresponding indentation 171 or trough in opposing wall 17 for connection between walls 15 and 17 of two containers 10. The projection 151 or indentation 171 or both can be formed integrally with either the corresponding walls of the container, or with the corresponding walls of the cap 20. As shown in FIGS. 1 and 4, one or both of walls 15, 17 may be angled relative to the bottom 18 at greater than ninety degrees, whereby attachment of adjacent walls 15, 17 as described results in a radial array of two or more containers 10. Also, as a result of symmetry of the described projection/indentation interconnection systems of the containers, the containers can be connected with altering orientation of the cap 20 and bottom 18, where for example the cap 20 and cover 201 of one container is positioned opposite the cap 20 and cover 201 of an adjacent container.

The invention thus provides a novel container and novel combinations of containers for holding and dispensing any type of product with suitable dimensions. When combined by the described connections, multiple containers can be used to market and hold the same or complimentary products. The container walls can be made transparent for easy identification of contents, and the caps colored for aesthetics and/or content reference. The covers 201 of caps 20 can be oriented to each open in the same direction or otherwise. The overall dimensions of the containers 10, as primarily dictated by the sizes of the four walls, can be in any practical range and appropriate for the intended use. Also, the size and shape of the cap 20 can vary apart from the body 12.

In one particular application, the containers can be used as dispensers for items such as stickers, and wherein multiple containers can be connected together for coordinated storage and dispensing of stickers of corresponding themes. Other applications such as for use with other types of office products, or with candy or gum are possible.

The illustrated embodiment is merely representative of the inventive principles and concepts which may be executed in a wide variety of alternate forms which embody the structural and functional features of the device and combinations thereof.

What is claimed as the invention is:

1. A container comprising:

a bottom;

four side walls rising from the bottom, the four side walls including:

a first side wall having at least one projection;

a second side wall opposed to the first side wall and having at least one indentation which corresponds in shape, size and location to the at least one projection of the first side wall;

a third side wall which extends from the first side wall to the second side wall, the third side wall having at least one projection;

a fourth side wall opposed to the third side wall and which extends from the first side wall to the second side wall, and which has at least one indentation which corresponds in shape, size and location to the at least one projection of the third side wall, and a cap attached to the four side walls, the cap having four side walls which fit over the side walls of the container, an opening in one of the side walls of the cap which corresponds in shape, size and location with a projection in a side wall of the container, and a cover attached to the cap, and wherein the projection of the first side wall is in the form of an annular projection, and the indentation in the second side wall is in the form of an annular indentation.

2. The container of claim 1 wherein the first and second side walls are wider than the third and fourth side walls.

3. The container of claim 1 wherein the cap extends beyond the four side walls.

4. The container of claim 1 wherein the cover is attached to the cap by a hinge.

5. The container of claim 1 wherein the projection of the third side wall is in the form of a rib, and the indentation in the fourth side wall is in the form of a trough.

6. The container of claim 1 wherein one of the third or fourth walls rises from the bottom at an angle greater than ninety degrees.

7. The container of claim 1 wherein the cap extends over a portion of at least one of the side walls and is flush with at least one of the side walls.

8. The container of claim 1 wherein the cover is connected to the cap by a hinge.

9. The container of claim 1 wherein the cover is generally aligned with the first and second side walls.

* * * * *